US008235478B2

(12) United States Patent
Zimmer et al.

(10) Patent No.: US 8,235,478 B2
(45) Date of Patent: Aug. 7, 2012

(54) ACCELERATION DEVICE WITH TWO ENERGY STORES

(76) Inventors: Günther Zimmer, Rheinau (DE); Martin Zimmer, Rheinau (DE)

( * ) Notice: Subject to any disclaimer, the term of this patent is extended or adjusted under 35 U.S.C. 154(b) by 0 days.

(21) Appl. No.: 12/925,762

(22) Filed: Oct. 28, 2010

(65) Prior Publication Data

US 2011/0080080 A1 Apr. 7, 2011

Related U.S. Application Data

(63) Continuation-in-part of application No. PCT/DE2009/000583, filed on Apr. 28, 2009.

(30) Foreign Application Priority Data

Apr. 29, 2008 (DE) ..... 10 2008 021 458

(51) Int. Cl.
*A47B 95/00* (2006.01)

(52) U.S. Cl. ..... 312/333; 312/319.1

(58) Field of Classification Search .... 312/334.4–334.6, 312/334.8, 334.14, 350, 319.1, 334.47, 334.7, 312/334.46, 334.44, 333; 384/22
See application file for complete search history.

(56) References Cited

U.S. PATENT DOCUMENTS

| | | | | |
|---|---|---|---|---|
| 6,736,471 | B2 * | 5/2004 | Lin | 312/333 |
| 6,846,053 | B2 * | 1/2005 | Salice | 312/334.14 |
| 6,910,557 | B2 * | 6/2005 | Doornbos et al. | 188/290 |
| 6,953,233 | B2 * | 10/2005 | Lam et al. | 312/333 |
| 7,399,041 | B2 * | 7/2008 | Prentner et al. | 312/333 |
| 2006/0186772 | A1 * | 8/2006 | Lam et al. | 312/333 |
| 2007/0114896 | A1 * | 5/2007 | Orita | 312/334.14 |
| 2009/0273263 | A1 * | 11/2009 | Berger | 312/334.1 |

FOREIGN PATENT DOCUMENTS

| | | | |
|---|---|---|---|
| DE | 20 2004 005 322 | U1 | 4/2005 |
| WO | WO 2005/102108 | A1 | 11/2005 |
| WO | WO 2006066774 | A1 * | 6/2006 |
| WO | WO 2008/034626 | A2 | 3/2008 |

* cited by examiner

*Primary Examiner* — Darnell Jayne
*Assistant Examiner* — Andres F Gallego
(74) *Attorney, Agent, or Firm* — Klaus J. Bach

(57) ABSTRACT

In an acceleration device including a carrier element movably disposed in a housing together with a first energy store which is connected to the carrier element for moving the carrier element from a locked parking position to an end position while its energy is being discharged, a second energy store, which is charged with an initial energy amount when the carrier element is in the parking position, is associated with a guide element and is discharged upon release of the carrier element from the parking position while the carrier element is moved to an end position opposite the parking position. The second energy store, while being discharged to a residual energy amount, controls, by means of the guide element, the energy change rate of the first energy store at least in a part of its discharge time interval.

8 Claims, 3 Drawing Sheets

ACCELERATION DEVICE WITH TWO ENERGY STORES

This is a Continuous-In-Part Application of pending international patent application PCT/DE2009/000583 filed Apr. 28, 2009 and claiming the priority of German patent application 10 2008 021 458.2 filed Apr. 28, 2008.

BACKGROUND OF THE INVENTION

The invention resides in an acceleration device with a carrier element which is guided in a housing and which is movable into an end position from a force or form-locked park position by means of an energy store being discharged from an initial energy content to a residual energy content, and also to a combined deceleration and acceleration d with such an acceleration device.

DE 20 2004 005 322 U1 discloses an acceleration device in which, for changing the pretension of a tension spring, the position of a spring reversing roller can be changed. With this feature the utilized operating range of the linear spring characteristic can be changed.

It is the principal object of the present invention to provide an acceleration device and a combined deceleration and acceleration arrangement with an energy store wherein at least the dynamic properties of the acceleration device can be changed.

SUMMARY OF THE INVENTION

In an acceleration device including a carrier element movably disposed in a housing together with a first energy store which is connected to the carrier element for moving the carrier element from a locked parking position to an end position while its energy is being discharged, a second energy store is associated with a guide element and is charged with an initial energy amount when the carrier element is in the parking position, the second energy store being discharged upon release of the carrier element from the parking position while the carrier element is moved to an end position opposite the parking position. The second energy store, while being discharged to its residual energy amount, controls, by means of the guide element, the energy change rate of the first energy store at least in a part of the discharge time interval of the first energy store.

The invention will become more readily apparent from the following description of a particular embodiment thereof described below with reference to the accompanying drawings.

DESCRIPTION OF EXEMPLARY EMBODIMENTS

Figure 1:
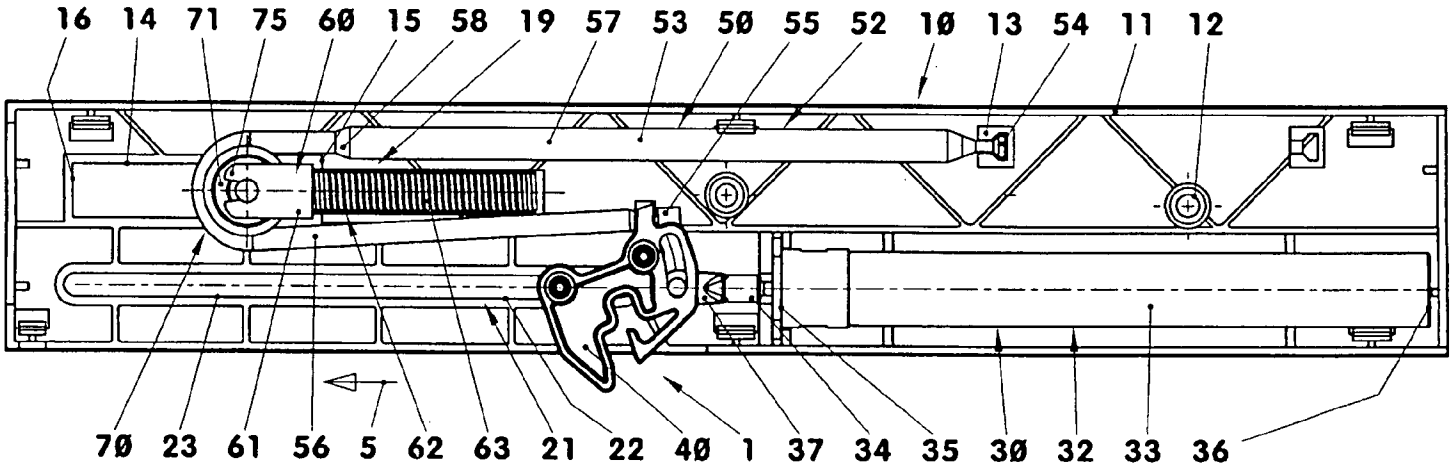
FIG. 1 shows a combined deceleration and acceleration device including a carrier element in a parking position.
Figure 2:
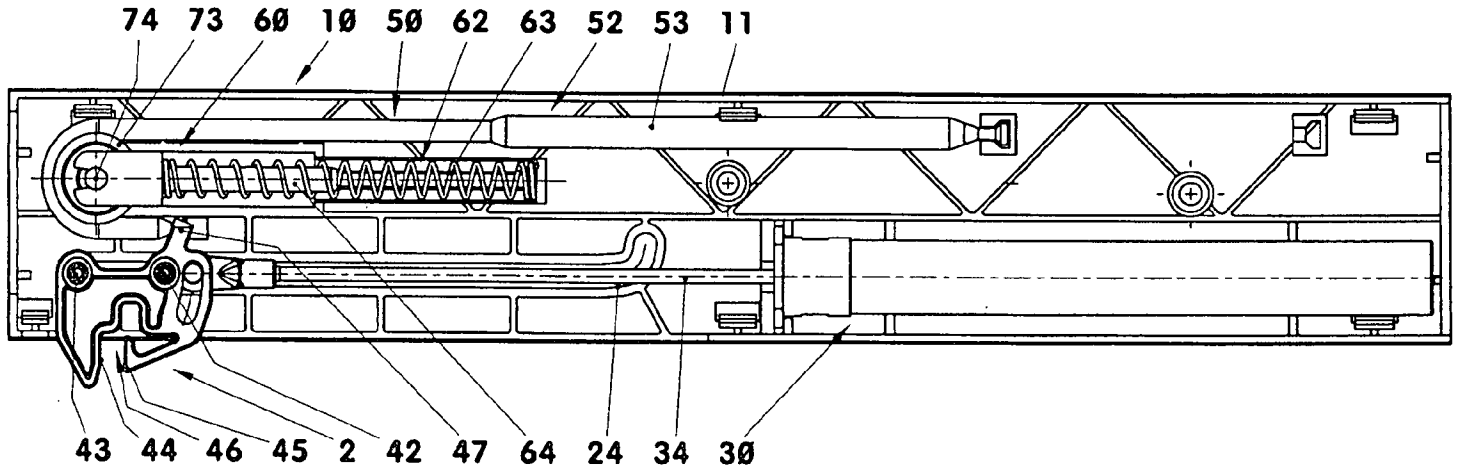
FIG. 2 shows a device as shown in FIG. 1 with the carrier element in an end position.

FIGS. 1 and 2 each show, in a longitudinal sectional view, a combined deceleration and acceleration device 10 with a housing 11 and a carrier element 40 movably supported in the housing 11. The carrier element 40 is movable from a force- and/or form-locked park position 1 as shown in FIG. 1 to an end position 2 as shown in FIG. 2 and back again.

Such a deceleration- and acceleration device 10 is used for example as part of a guide system, for example, a drawer guide arrangement or a sliding door arrangement in order for example to brake a movable furniture part with respect to a stationary furniture part in a controlled manner and move it into an end position. Here, the deceleration- and acceleration device 10 is attached to one of the two relatively movable furniture parts. At the respective other furniture part, an operating element is arranged which is not shown. The housing 11—of the two housing parts which are for example mirror-reversed structures, only one housing part is shown—includes for example two through-bores 12 via which the housing can be mounted to the furniture part by mounting means.

For example, during closing of a drawer the operating element of the carrier element 40 comes into contact with the carrier element in a partial stroke length next to the end position of the drawer and causes its release from the parking position 1 and carries it in closing direction 5 along a guide arrangement 21 to the end position 2, see FIG. 2.

As soon as the operating element has released the carrier element 40 from the parking position 1, the movement of the drawer is retarded by the retarding arrangement 30. For example, at the same time, the acceleration device 50 is activated which pulls the drawer for example into the closed end position against the action of the retardation arrangement 30. The carrier element 40 remains in engagement with the operating element until the drawer reaches the end position.

Upon opening of the drawer, the operating element pulls the carrier element 40 from the end position 2 into the park position 1. There, the operating the element disengages the carrier element 40.

The deceleration device 30 comprises a cylinder piston unit 32 of which only the cylinder 33 and the piston rod 34 are shown in FIGS. 1 and 2. The cylinder-piston unit 32 may be operated pneumatically or hydraulically. The displacement chamber is disposed in this embodiment between the piston and the cylinder head 35. The compensation chamber is delimited by the piston and the cylinder bottom wall 36.

The stroke length of the piston and the piston rod 34 is for example 110 mm. On the piston rod head 37, the carrier element 40 is pivotally supported. In the embodiment as shown in FIGS. 1 and 2, the pivot axis extends normal to the drawing plane.

The acceleration device 50 comprises an energy store 52 which is attached to the carrier element 40 and the housing 11 in each case in a U-shaped cavity 47, 13 and a guide arrangement 60 disposed in the housing 11.

The energy store 52 is for example a mechanical energy storage device which, in this embodiment, comprises a tension spring 53. The tension spring 53 has for example two areas 56, 57 of different diameters of which the area 56 of smaller diameter abuts a redirection device 70 and extends around an area thereof. The wrap-around angle for example in the parking position 1 of the carrier element is 183°—see FIG. 1.

The tension spring 53 may have a constant diameter. In a relatively long housing the spring 53 may be provided without any redirection arrangement. It is furthermore possible to arrange, instead of a tension spring 53, a compression spring, a spiral spring etc. between the housing 11 and the carrier element 40. In this case, for example, a rope may be arranged between the spring and the carrier element 40. The carrier element 40 may also be connected to the energy store 52 by means of a drive for example a lever drive.

The tension spring 53 shown in FIGS. 1 and 2 has a nominal length of for example 170 mm, that is, the length of the relaxed spring between the engagement locations 54, 55. Its total stroke length is for example 116 mm, i.e. about 68% of the nominal length. In the representation of FIG. 2, the tension spring 53 is relaxed up to a residual stroke of 76 mm and in FIG. 1 it is lengthened by the total stroke length. The utilized stroke length of the tension spring 53 is for example 31% of the stroke length of the carrier element 40. It is consequently less than 80% of the stroke length of the carrier element 40. In the charged state, the beginning energy value of the tension spring 53 provides for a tension force of 20 Newtons. In the discharged state as shown in FIG. 2, the residual energy content of the tension spring 53 corresponds to a tension force of for example 11 Newtons.

The single-part tension spring 53 has, in this embodiment, a constant wire diameter of for example 0.85 mm. The first area 56 of the spring 53 next to the carrier has for example an outer diameter of 4.7 mm. Its length in a relaxed state is for example 55% of the nominal length of the spring 53. Adjacent the first area 56 is a transition area 58 followed by the housing-side second area 57 of the spring 53 which has for example an outer diameter of 7.1 mm. Its relaxed length is in the exemplary embodiment about 44% of the nominal length of the spring 53. The diameter of the second area 57 is greater than 1.5 times the diameter of the first area 56.

The spring stiffness of the first area 56 is in the exemplary embodiment 0.16 Newton/mm. The spring stiffness of the second area 57 is for example 0.1 Newton/mm. The inverse value of the overall stiffness of the tension spring 53 is in this serial arrangement of the spring areas 56, 57, the sum of the inverse values of the individual spring stiffnesses. The tension spring 53 may also have more than two areas of different spring stiffness. In an embodiment of the tension spring with a constant outer diameter and a constant wire thickness, the spring stiffness is constant over the full length of the spring 53.

The energy stored in the tension spring 53, measured in Joule, is determined by the integral of the spring force along the spring stroke. In the exemplary embodiment, the first energy store 52 is fully charged in the parking position 1. This energy value is designated below as beginning energy value of the first energy store 52. The residual energy value of the first energy store 52 is the energy value which the tension spring 53 has when it is in the end position 2. The energy changing rate of the first energy store 52 is obtained by differentiation of the energy function over time.

The guide arrangement 60 comprises a guide element 61 and an energy store 62 which, below, will be called the second energy store 62.

The guide element 61 is for example a parallelepiped guide carriage 61 which is firmly guided in the housing 11 at opposite sides thereof in guide grooves 14. The guide grooves 14 extend straight and, for example, parallel to the guide arrangement 21 of the carrier element 40. They may be narrower than the guide carriage 61. The guide carriage 61 then has for example a guide groove which projects into the housing groove 14. At both front ends thereof the guide grooves 14 are delimited by stop strips 15, 16. These stop strips 15, 16 may be adjustable so as to point to reduce the length of the guide grooves 14 or to extend it in order to change the extent of the guide grooves 14 in the housing 11. It may in certain cases be sufficient to adjust the stop location of only one guide groove 14.

At its front side remote from the tension spring 53, the guide carriage 61 is provided for example with a guide rod 64. The guide rod 64 extends into the second energy store 62 and is guided thereby. The second energy store 62 comprises for example a compression spring 63, which is supported by the guide carriage 61 and the housing 11.

The compression spring 63 has for example an outer diameter of 8.5 mm and a wire thickness of 0.7 mm. The partially relaxed compression spring 63 shown in FIG. 2 has a length of 85 mm and a residual force of 11 Newton. In a compressed state as shown in FIG. 1, the length of the spring is 42.5 mm and the force is 19.8 Newton. The stroke of the compression spring 63 is consequently 39% of the stroke of the carrier element 40. It is in this embodiment, less than 70% of the stroke of the carrier element 40.

Instead of being in the form of a compression spring 63, the second energy store 62 may also be a tension spring. This tension spring is then arranged for example outside the space 19 surrounded by the first energy store 52 between the housing 11 and the guide carriage 61.

Based on an individual operation, the second energy store 63 has for example a constant energy changing rate with regard to its discharge and recharge time interval. The stroke of this compression spring 63 is limited by the stroke limits of the guide carriage 61. The discharge time interval is in the exemplary embodiment that time interval which is needed by the guide carriage 61 for its movement from the right hand stop 15, see FIG. 1, to the left hand stop 16.

The housing 11 may be provided with for example a spring-loaded engagement structure which locks the guide carriage 61 in the park position 1. When the engagement force is exceeded, the guide carriage 61 is released. It is also possible to engage the guide carriage 61 in a direction normal to the guide grooves 14 for example by means of an additional spring. Then the guide carriage 61 is released when the force of the second energy store 62 exceeds the static friction generated by the additional spring.

In the exemplary embodiment, the reversing structure 70 is arranged at the side of the guide carriage remote from the second energy store 63. The reversing structure 70 comprises for example a reversing roller 71 which is rotatably supported by a shaft 74 and which has a running surface that is delimited at opposite sides by means of guide discs 73. The shaft 74 is supported for example in a fork-like receiver 75 of the guide carriage 61. Instead of a rotatable redirecting roller 71 also a redirecting element may be used which is stationary relative to the guide carriage 61.

In an embodiment of the deceleration and acceleration device 10 with a reversing structure 70, which is rotatably supported directly in the housing 11, the guide arrangement 60 may act on the first energy store 52 at another location.

In the exemplary embodiment of FIGS. 1 and 2 the carrier element 40 is guided in the guide arrangement 21 for example by means of two guide bolts 42, 43. The guide arrangement 21 comprises two guide grooves 22 which are arranged in the housing 11 opposite each other and of which only on is shown in the longitudinal cross-sectional view of FIGS. 1 and 2.

The carrier element 40 includes two engagement shoulders 44, 45 which project from the housing 11 to different levels. Herein, the engagement shoulder 44 remote from the cylinder 33 projects further than the engagement shoulder 45 closer to the cylinder 33. The two engagement shoulders 44, 45 delimit a carrier recess 46.

The two guide grooves 22 form a straight section 23 and an adjacent curved section 24. The latter is curved upwardly in the arrangement as shown in FIGS. 1 and 2. The center-lines of the guide tracks 22 define a plane in which also the center line of the piston rod 34 is disposed. At its side remote from the carrier recess 46, the carrier element 40 includes a spring holder 47.

Upon installation of the combined deceleration and acceleration device 10 in a guide system, the carrier element 40 is for example in the parking position 1 when the drawer is open as shown in FIG. 1. The piston rod 34 of the cylinder piston unit 32 is retracted. The first energy store 52 and the second energy store 62 are charged. The guide arrangement 60 is disposed at the right stop 15. The tensioned tension spring 53 is so arranged that the extended low spring stiffness area 57 is not in contact with the reversing roller 71.

When the drawer is being closed, the operating element provided on the drawer contacts the carrier element 40 at the engagement shoulder 44 thereof and pulls it out of the parking position 1. The carrier element 40 is pivoted thereby so that the engagement shoulders 44, 45 engage the operating element therebetween. With further relative movement between the two furniture parts the operating element pulls the carrier element 40 along the guide arrangement 21 toward the end position 2. The piston rod 34 of the cylinder-piston unit 32 is pulled out of the cylinder. In the deceleration device 30, the piston of the cylinder piston unit 32 compresses a medium in the displacement chamber. In the process the pneumatic or hydraulic medium pressurized in the displacement chamber can be throttled into the compensation chamber. Depending on conditions, for example in connection with a hydraulic cylinder-piston unit 32, additional hydraulic fluid may be supplied to the compensation chamber from an external compensation container. The throttling effect may become smaller along the piston stroke movement, for example. The movement of the carrier element 40—and consequently of the drawer—is braked.

At the beginning of the stroke movement of the carrier element 40, the acceleration device 50 acts on the carrier element 40. The tension spring 53 contracts and pulls the carrier element 40 toward the end position 2. The first energy store 52 is being discharged.

Figure 3:
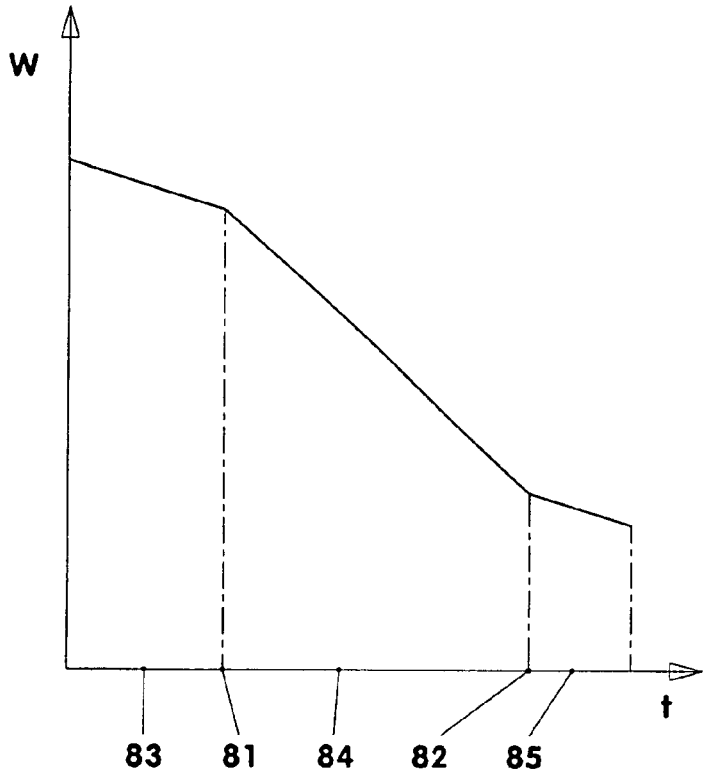
FIG. 3 shows an energy-time diagram of the first energy store.

FIG. 3 shows the stored energy of the first energy store as ordinate value over the discharge time interval shown on the abscissa in a highly simplified manner. The measuring unit of the discharge time interval is seconds. Because of the small energy and time intervals considered herein the energy function is represented in straight-line sections. At the point in time of the coordinate origin, the operating element is in contact with the carrier element 40. The energy stored in the tension spring 53 drops from an initial energy value down to a first point in time '81 at for example a constant energy discharge rate.

As soon as the force for the tension spring 53 acting on the reversing structure 70 is smaller than the threshold force value of the compression spring 63 caused by the initial energy value and a possible engagement or friction force of the compression spring 63, the compression spring 63 moves the guide carriage 61 together with the reversing structure 70 toward the left as shown in FIG. 1. During this process, the second energy store 62 releases its energy. The guide carriage 61 including the reversing structure 70 is moved along the housing guide groove 14. The first energy store 52, which abuts the reversing structure 70, is in this way firmly guided by the guide arrangement 60.

The energy discharge of the second energy store 62 causes for example a reduction of the energy discharge per time unit of the first energy store 52. The amount of the energy change rate of the first energy store 52 becomes smaller. In the diagram of FIG. 3, this is represented by the second time interval 84 between the first and second points in time 81, 82. The change of the stored energy of the first energy store 52 occurs along a flatter straight line than in the first time interval 83.

As soon as the guide arrangement 60 has started moving, also the quotient of advancement force effective on the carrier element 40 and the stroke travel of the carrier element changes. This quotient is a measure for the spring stiffness of the overall system. The value of this quotient is for example less than the value of the corresponding quotient of the first energy store 52. This value may be lower than the minimum value of the spring stiffness of an individual spring for the force difference and the stroke of the carrier element 40. The minimal required spring stiffness of this individual spring is determined from the maximum spring diameter, the minimum spring wire thickness and the material-dependent maximally admissible shearing stress.

When the guide carriage 61 has reached the left hand stop 16, the second energy store 62 abuts the stop 16 and the first energy store 52 with the residual force generated by its residual energy value. Upon further movement of the carrier element 40, the first energy store 52 is no longer controlled by means of the second energy store 62.

In the diagram of FIG. 3, the guide carriage 61 reaches the left hand stop 16 at the second point in time 82. The energy change rate of the first energy store 52 now corresponds to the energy change rate effective during the first time interval 83.

The spring stiffness of the complete system corresponds now again to the spring stiffness of the tension spring 53.

As soon as the carrier element 40 has reached the end position 2 the first energy store 52 still has a residual force value. The tension spring 53 holds the carrier element 40 in the end position 2 with the residual force of the tension spring 53.

With the acceleration arrangement described the drawer is accelerated against the effect of the retardation device 30 and is moved slowly to for example its closed end position. Here it comes to a stop without jerk. As a result, with this device the dynamic behavior of the acceleration device 50 can be influenced.

The discharge time interval of the second energy store 62 may also be at the beginning or the end of the discharge interval of the first energy store 52. Also, the discharge time interval of the second energy store 62 may overlap one or both of the end points of the discharge time interval of the first energy store 52. It would also be possible for the two discharge time intervals to be identical.

Figure 4:
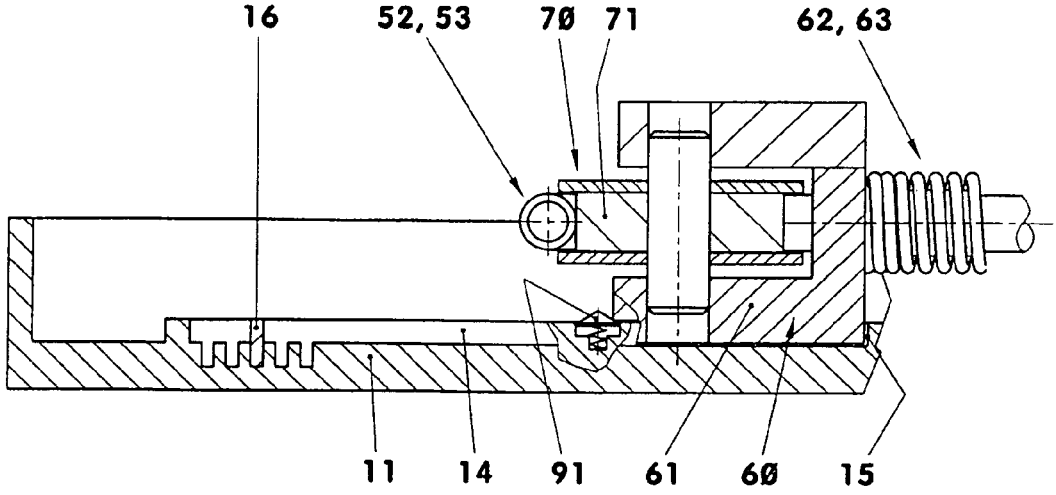
FIG. 4 is a partial cross-sectional view of an acceleration device with an adjustable stop and an engagement element.

If, for example, the end point of the discharge time interval of the second energy store 62 is to be advanced in time, the stop 16 in FIG. 4 for example may be displaced to the right. This can be achieved for example by displacement and locking. Also a displacement of the stop by means of adjustment screws is possible. In this way, the residual energy value of the second energy store 62 is increased. For example, the time interval of the value of the lower discharge rate of the first energy store 52 can be shortened thereby.

In order to move the end point of the discharge time interval of the second energy store 62 timely backward for example, the stop 16 in the FIG. 4 is displaced toward the left.

In order to advance timely the energy discharge rate of the first energy store 52, the right hand stop 15 for the guide arrangement 60 can be displaced to the right.

If the energy discharge rate of the first energy store 52 should be influenced at a later point in time, for example, the spring-loaded engagement stop 91 may be formed as shown in FIG. 4. The charged second energy store 62 biases the engagement stop of the guide carriage 61 downwardly and overcomes it as soon as the load of the reversing structure 70 drops below a threshold value.

The deceleration and acceleration device 10 may be so designed that the energy change per time unit is essentially constant. For the operator, a uniform movement of the drawer is achieved in this way.

During opening of the drawer, the operating element moves the carrier element 40 from the end position 2 to the parking position 1. The piston rod 34 with the piston is moved inwardly almost without any resistance. The tension spring 53 is tensioned wherein the extension of the area 57 of low spring stiffness is greater than the extension of the area 56 of the high spring stiffness. At the same time, the compression spring 63 is compressed as soon as the force effective on the reversing structure 70 exceeds the pressure force of the compression spring 63. With further movement of the carrier element 40, the guide carriage abuts for example the right hand stop 16. The second energy store 62 is now charged to its initial energy value.

With further movement of the carrier element 40, only the first energy store 52 is further charged. As soon as the carrier element 40 reaches the parking position 1, the operating element is released from the combined deceleration and acceleration device 10. Both energy stores 52, 62 are now charged to the respective initial energy values. The drawer can now be fully opened.

The time intervals for the charging of the first energy store 52 and the second energy store 62 may differ from the discharge time intervals. The charging rate of the two energy stores may be essentially constant over the whole charging time interval. The operator can consequently supply to the device an essentially constant energy amount per time unit over the whole interval.

Figure 5:
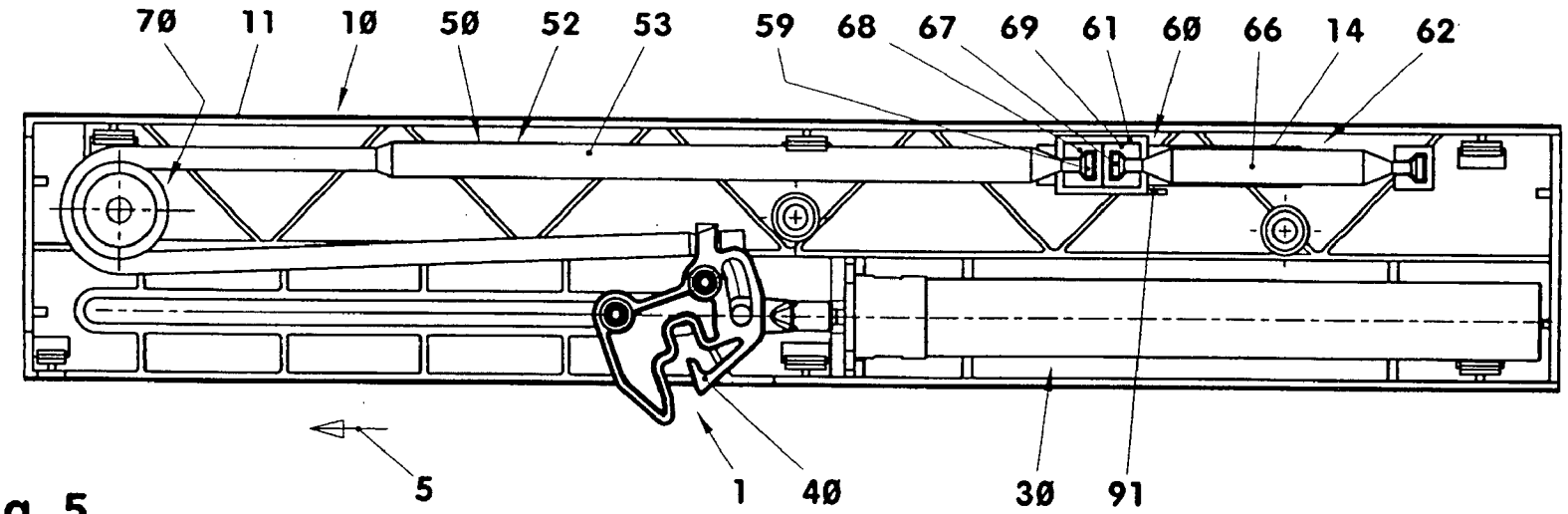
FIG. 5 shows a combined deceleration- and acceleration device with a guide arrangement guiding the energy store at one end thereof in the park position.
Figure 6:
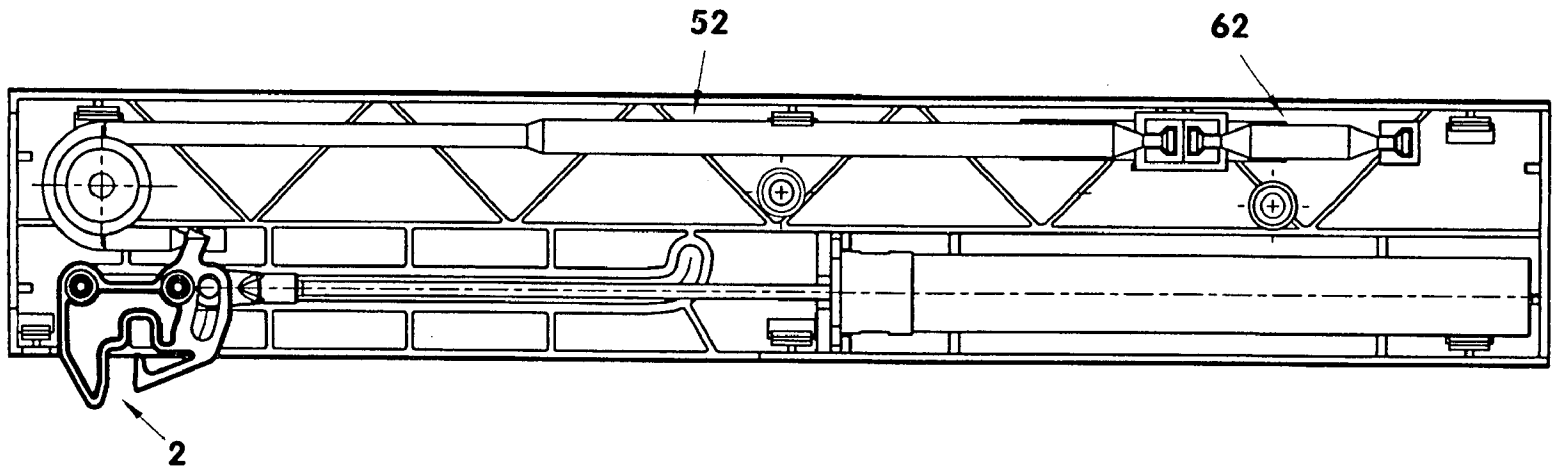
FIG. 6 shows the arrangement of FIG. 5 with the carrier element in the end position.

FIGS. 5 and 6 show a deceleration and acceleration device 10 in which the second energy store 62 supports the housing-side end 59 of the first energy store 52. In this exemplary embodiment, both energy stores 52, 62 are tension springs 53, 63 whose adjacent spring ends 59, 67 are accommodated each in a spring receiver 68, 69 attached to the guide carriage 61. The guide carriage 61 is for example movable in a guide structure 14 of the housing between two housing-side, for example adjustable, stops 15, 16. An engagement stop 91 holds the guide carriage 61 including the second energy store 62 in the initial position until a force threshold value is exceeded.

The housing 11, the deceleration device 30, the carrier element 40, the first energy store 52, the guide carriage 61, the stops 15, 16 and the engagement element 91 are for example of a design similar to those described in connection with the exemplary embodiment of the FIGS. 1 and 2. The reversing structure 70 is for example mounted in the housing 11.

As soon as the operating element causes the release of the carrier element 40, the charged first energy store 52 pulls the carrier element 40 out of the parking position 1 toward the end position 2. After the release of the guide carriage 61, the two energy stores 52, 62 release kinetic energy. The energy change rate of the first energy store 52 decreases. The movement of the carrier element 40 is accelerated until the second energy store 62 has reached its residual energy level. For example, in this time interval, the inverse value of the spring stiffness of the acceleration device 50 corresponds to the sum of the inverse values of the individual spring stiffnesses of the two tension springs 53, 66. When the second energy store 62 has reached its residual value, the carrier element 40 is driven only by means of the first energy store 52. The energy changing rate of this energy store 52 now assumes again the original value.

In this exemplary embodiment, the stroke length of the first tension spring 53 is for example 80% of the travel length of the carrier element 40.

Also, the acceleration device 50 can be so adjusted that the energy release over time remains essentially constant. It is also possible to design the device in such a way that the achieved spring stiffness is lower than the minimally permissible spring stiffness of an individual spring, which makes the stroke of the carrier element 40 possible with the same forces.

The energy change of the first energy store 52 and the second energy store 62 may be progressive, regressive, intermittent or non-linear. Also combinations of the exemplary embodiments described above are possible.

LIST OF REFERENCES

| | |
|---|---|
| 1 | Parking position |
| 2 | End position |
| 5 | Insert direction |
| 10 | Combined deceleration and acceleration arrangement |
| 11 | Housing |
| 12 | Through-bores |
| 13 | U-shaped cavity |
| 14 | Guide groove |
| 15 | Stop, stop strip |
| 16 | Stop, stop strip |
| 19 | Space surrounded by energy store |
| 21 | Guide arrangement |
| 22 | Guide groove |
| 23 | Straight-line section |
| 24 | Curved section |
| 30 | Deceleration device |
| 32 | Cylinder piston unit |
| 33 | Cylinder |
| 34 | Piston rod |
| 35 | Cylinder head |
| 36 | Cylinder bottom wall |
| 37 | Piston rod head |
| 40 | Carrier element |
| 42 | Guide bolt |
| 43 | Guide bolt |
| 44 | Engagement shoulder |
| 45 | Engagement shoulder |
| 46 | Carrier recess |
| 47 | Spring holder |
| 50 | Acceleration device |
| 52 | First energy store |
| 53 | Tension spring |
| 54 | Engagement location |
| 55 | Engagement location |
| 56 | First area of tension spring |
| 57 | Low spring stiffness area |
| 58 | Transition area |
| 59 | End of tension spring |
| 60 | Guide arrangement |
| 61 | Guide element carriage |
| 62 | Second energy store |
| 63 | Compression spring |
| 64 | Guide rod |
| 66 | Tension spring |
| 67 | End of tension spring |
| 68 | Spring receiver |
| 69 | Spring receiver |
| 70 | Reversing structure |
| 71 | Reversing roller |
| 73 | Guide discs |
| 74 | Shaft |
| 75 | U-shaped recess |
| 81 | First point in time |
| 82 | Second point in time |

-continued

| | |
|---|---|
| 83 | First time interval |
| 84 | Second time interval |
| 85 | Third time interval |
| 91 | Engagement stop |
| W | Energy |
| t | time |

What is claimed is:

1. An acceleration device (50) including: a housing (11), a carrier element (40) movably supported in the housing (11), and a first energy store (52) of low stiffness disposed in the housing (11) and connected to the carrier element (40) for moving the carrier element (40) from a force or form-locked parking position (1) to an end position (2) by a discharge of the first energy store (52), said acceleration device (50) including a guide arrangement (60) with a second energy store (62) of higher stiffness than that of the first energy store (52), both energy stores (52, 62) being charged to initial energy values when the carrier element (40) is in the parking position (1) and being discharged to residual energy values during movement of the carrier element (40) to the end position, the guide arrangement (60) including a guide element (61) for firmly guiding the first energy store (52), and the second energy store (62), which, upon the release of the carrier element (40) from its parking position (1) by an external operating element, is discharged from its initial energy value to its residual energy value while moving the carrier element (40) toward its end position (2), controlling, by means of the guide element (61), the energy change rate of the first energy store (52) at least in a partial interval of the discharge interval of the first energy store (52); wherein the guide arrangement (60) is guided in the housing (11) in a straight line guide structure (14) and the carrier element (40) is guided in a guide track (21) extending essentially parallel to the guide structure (14) and a deceleration device (30) including a piston rod (34) is arranged in alignment with the guide track (21) with the piston rod (34) being connected to the carrier element (40).

2. The acceleration device according to claim 1, wherein a stroke length of the guide arrangement (60) is limited by means of at least one stop (15, 16).

3. The acceleration device according to claim 2, wherein the at least one stop (15, 16) is adjustable.

4. The acceleration device according to claim 1, wherein the discharge time interval of the first energy store (52) is at least equal the discharge time interval of the second energy store (62).

5. The acceleration device according to claim 4, wherein the discharge intervals of the first energy store (52) and the second energy store (62) end at the same point in time.

6. The acceleration device according to claim 1, wherein at least the first energy store (52) is a tension spring (53).

7. The acceleration device according to claim 6, wherein the tension spring (53) extends at least partially around a redirecting structure (70) supported by the guide arrangement (60).

8. A combined deceleration and acceleration device (10) including an acceleration device (50) including: a housing (11), a carrier element (40) movably supported in the housing (11), and a first energy store (52) of low stiffness disposed in the housing (11) and connected to the carrier element (40) for moving the carrier element (40) from a force or form-locked parking position (1) to an end position (2) by a discharge of the first energy store (52) from an initial energy value to a residual energy value, said acceleration device (50) including a guide arrangement (60) with a second energy store (62) of a stiffness higher than that of the first energy store (52) which is also charged to an initial energy value when the carrier element (40) is in the parking position (1), the guide arrangement (60) including a guide element (61) for firmly guiding the first energy store (52), and the second energy store (62), which, upon the release of the carrier element (40) from its parking position by an external operating element, is discharged from an initial energy value to a residual energy value, controlling, by means of the guide element (61), the energy change rate of the first energy store (52) at least in a partial interval of the discharge interval of the first energy store (52) at the end of the movement of the carrier element (40); wherein the guide arrangement (60) is guided in the housing (11) in a straight line guide structure (14) and the carrier element (40) is guided in a guide track (21) extending essentially parallel to the guide structure (14) and a deceleration device (30) including a piston rod (34) is arranged in alignment with the guide track (21) with the piston rod (34) being connected to the carrier element (40).

* * * * *